US005765613A

United States Patent [19]

Schrager

[11] Patent Number: 5,765,613

[45] Date of Patent: Jun. 16, 1998

[54] BAG ENGAGEMENT SYSTEM

[76] Inventor: Lawrence A. Schrager, 32 Lincoln Ave., Highland Park, N.J. 08904

[21] Appl. No.: 766,459

[22] Filed: Dec. 12, 1996

[51] Int. Cl.[6] ..... B65F 1/06

[52] U.S. Cl. ..... 141/390; 141/314; 248/101; 248/95

[58] Field of Search ..... 141/314, 316, 141/390, 391; 248/95, 97, 98, 99, 101

[56] References Cited

U.S. PATENT DOCUMENTS

| | | | |
|---|---|---|---|
| 1,036,225 | 8/1912 | Hall | 141/314 |
| 1,600,996 | 9/1926 | Robichaux et al. | 141/314 |
| 1,713,095 | 5/1929 | Scheffler | 248/101 |
| 2,648,512 | 8/1953 | Scholin | 141/314 |
| 2,899,161 | 8/1959 | Bayard | 248/101 |
| 3,468,505 | 9/1969 | Reilly | 248/101 |
| 4,979,705 | 12/1990 | Bovitz | 248/97 |
| 5,172,824 | 12/1992 | Stutler | 248/101 |
| 5,190,252 | 3/1993 | Schrager | 248/97 |
| 5,193,770 | 3/1993 | Kildare | 248/97 |
| 5,238,139 | 8/1993 | Bisceglia | 248/101 |
| 5,611,507 | 3/1997 | Smith | 248/99 |

*Primary Examiner*—J. Casimer Jacyna
*Attorney, Agent, or Firm*—Charles J. Brown

[57] ABSTRACT

For use with a waste bin containing at least one bag for receiving a particular type of waste material, a bag engagement system for opening and closing the bag which includes an axially rotatable elongated gripper element for releasably gripping an edge portion of the bag, the bag being opened and closed by moving the gripper element back and forth over the opening of the bin, the gripper element capable of being locked to prevent its rotation so that the weight of the bag contents increases the grip of the gripper element on the bag edge portion.

27 Claims, 4 Drawing Sheets

BAG ENGAGEMENT SYSTEM

BACKGROUND OF THE INVENTION

In my U.S. Pat. No. 5,190,252 issued Mar. 2, 1993, I disclose a refuse bag support system for sorting and storing refuse of various types. That technology was understood to be particularly useful for residential households in which refuse of glass, plastic, metal, etc. are separated for recycling purposes. More recently recycling and refuse sorting has led to new practices in the non-residential sector, particularly in commercial offices, where refuse bag support and operation systems as described in my patent are not entirely suited to meet needs unique to office refuse collection.

Office refuse collection is now widely carried out such that paper is separated from all other refuse during the routine periodic custodial work. Typically it is required of office workers that they use waste baskets for refuse paper separate from other baskets for all other forms of refuse. Custodial personnel often make two passes through the same office area with a single bin, collecting the waste paper on one run and collecting the other refuse on another run. Obviously, that is a duplicative and therefore costly process. Alternatively, custodial personnel may pull two bins through the same area in one pass. A bin train of that sort is difficult to control and there is a danger that the multiple bins may damage office furniture or equipment. Also that procedure typically fails to utilize the full capacity of both bins since these different materials are rarely present in matching volumes. The double bin method has the additional disadvantages of requiring increased storage space and exacerbating carpet wear by the two trolleys needed for the bins.

By applying the concepts described in my earlier patent to commercial offices the problems of multiple passes or of multiple bins can be overcome to a large extent but not fully. That patented system permits a single bin to be used with multiple refuse bags in a manner such that a bag which holds refuse of large volume can expand as needed at the expense of a companion bag which needs only minimal space to receive refuse generated in lesser volume. However, the teachings of my patent in regard to the system for engaging the bags which permits them to be selectively opened and closed is open to improvement for non-residential settings where rapid and secure engagement of the bags is of considerable importance.

It is the object of the present invention to provide a bag engagement system wherein some form of gripping element may releasably grip an edge portion of one or more of the bags in a manner such that the weight of the bag contents itself increases the grip on the bag edge portion. U.S. Pat. No. 4,979,705 is relevant in this regard. It happens to concern laundry bags and a system for supporting them and permitting them to be opened and closed, but its teachings could be applied to refuse sorting as well. In that patent there are elongated gripper rods which extend through hemmed edges of a bag and which permit the bag to be opened and closed by sliding the rods on tracks away from and toward one another. Those prior art rods may be capable of being turned about their own axes but there is no suggestion of any means for locking the rods to selectively prevent rotation so that in some manner the weight of the bag contents can increase the grip of the rods on the engaged bag edge portion.

The bag engagement system provided by the present invention is a distinct improvement over the teachings of U.S. Pat. No. 4,979,705 applied to refuse bag support systems for sorting and storing refuse of varying types and volume as disclosed in my U.S. Pat. No. 5,190,252.

SUMMARY OF THE INVENTION

The present invention is intended for use with a bag-holding structure having an upper opening and adapted to contain at least one bag. A bag engagement system is provided for opening and closing the bag comprising axially rotatable elongated gripper element means on which an edge portion of the bag may be releasably gripped. Locking means is associated with the gripper element means to selectively prevent rotation of the gripper element means so that the weight of the bag contents increases the grip of the gripper element means on the bag edge portion. Support means is included for interconnecting the gripper element means with the bag-holding structure so that, with a bag edge portion opposite that gripped by the gripper element means held fixed, the bag may be selectively opened and closed by moving the gripper element means back and forth over the upper opening of the bag-holding structure.

In a preferred form of the invention, track means are included which are adapted to be secured adjacent the upper opening of the bag-holding structure and permitting access downwardly through said upper opening. The gripper element means may be a component of an arm assembly slidable back and forth along the track means. The track means may comprise parallel track members. The upper opening of the bag-holding structure may be defined by a peripheral portion and the bag engagement system may include a base member adapted to be placed against the peripheral portion of the bag-holding structure. The base member may include a clamp for releasable attachment to the peripheral portion of the bag-holding structure. The clamp may include a pivot permitting the track means to be selectively disposed over the opening of the bag-holding structure and alternatively swung aside from that opening to permit insertion and removal of the bag. The bag-holding structure may be adapted to contain at least two bags and the elongated gripper element means may be adapted to releasably grip joined edge portions of both of the two bags.

The arm assembly slidable back and forth along the track means may comprise a pair of elongated side-by-side gripper elements axially rotatable with respect to one another and forming nip means in which an edge portion of the bag may be releasably gripped with the weight of the bag contents increasing the grip on the bag edge portion. The gripper element pair may be rotated to wrap the bag edge portion about itself and then locked so that the weight of the bag contents holds the wrapped bag edge portion about the gripper element pair. In this embodiment each support element may define a bayonet slot having an enlarged opening into which an end of the associated gripper element pair may be moved to permit its rotation and a restricted opening into which the associated gripper element pair may be moved to lock against rotation. Washer means may be included on at least one end of the gripper element pair to prevent detachment from the associated support means. The gripper elements may be rods biased together by elastic means associated with the rod pair. The elastic means may be a pair of elastic bands encircling the rod pair adjacent the respective opposed ends of the rod pair.

Alternatively, the gripper elements may include opposed curved cam surfaces turnable and slidable between an open position allowing insertion of the bag edge portion between them and a closed position pinching the bag edge portion between them under the weight of the bag contents. Each support element may hang slidably on one of the track members.

The base member may comprise two base half members each with its own clamp and pivot and the track means may comprise a pair of track members one of which is secured to each of the respective two base half members. In another form of the invention the base member may comprise a single member with a clamp and pivot and the track means may comprise a pair of track members both secured to the single base member.

The track means may be elevated above the base member. The upper opening of the bag-holding structure may be circular and the base member may also be circular corresponding to the shape of the bag-holding structure opening.

DESCRIPTION OF PREFERRED EMBODIMENTS

Figure 1:
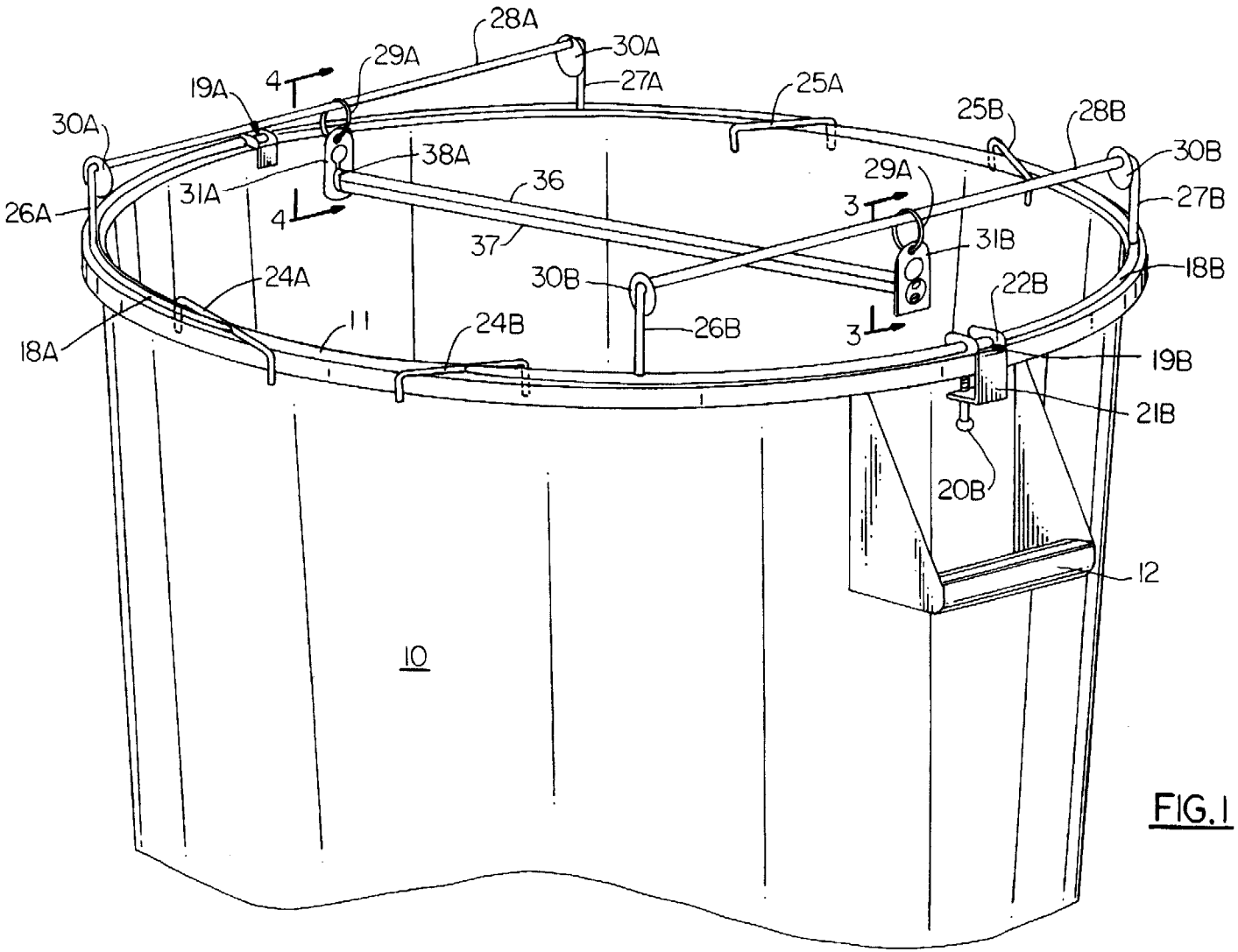
FIG. 1 is a fragmentary pictorial view of the upper portion of a circular refuse bin to which is attached a bag engagement system base member formed of two half members with no bag or bags yet within the bin.
Figure 2:
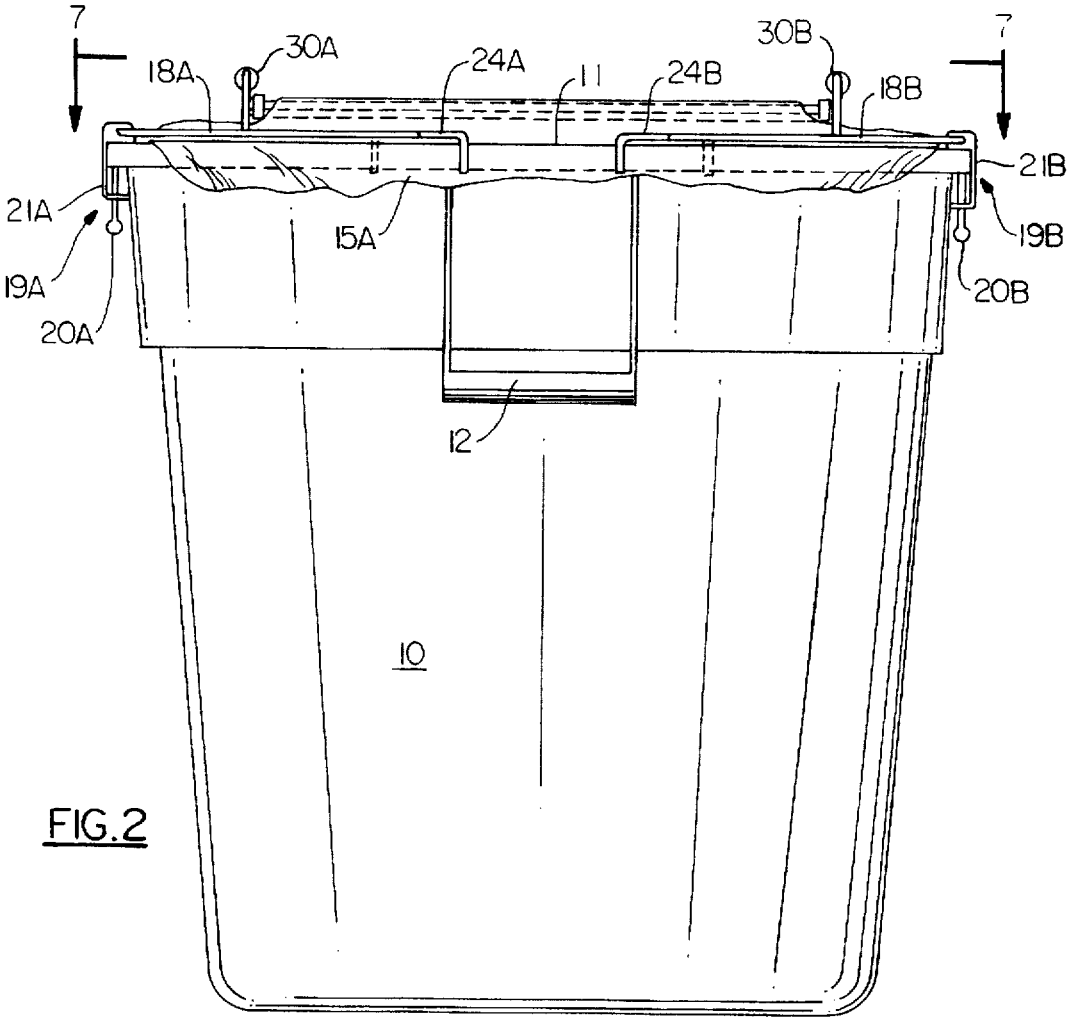
FIG. 2 is a side elevation of the bin and bag engagement system of FIG. 1 with an edge portion of one bag visible.

Referring first to FIGS. 1 to 8, the bag engagement system of the invention is shown in its intended use attached to a bag-holding structure or bin 10 around a peripheral portion 11 thereof. The bin 10 is of cylindrical shape, typically of 44 gallon capacity and unitary plastic construction. Conventional handles 12 extend integrally from the upper portion of the bin 10. The peripheral portion 11 of the bin 10 defines an upper circular opening. As shown particularly in FIG. 7, two plastic refuse bags 15 and 16 may be contained side-by-side within the bin 10 and are intended to receive separate types of refuse. For example, in office refuse collection the bag 15 may be utilized to receive paper and the bag 16 utilized to receive all other forms of refuse. The plastic bags 15 and 16 include bag edge portions 15A and 16A which are folded over the upper peripheral portion 11 of the bin 10.

Figure 8:
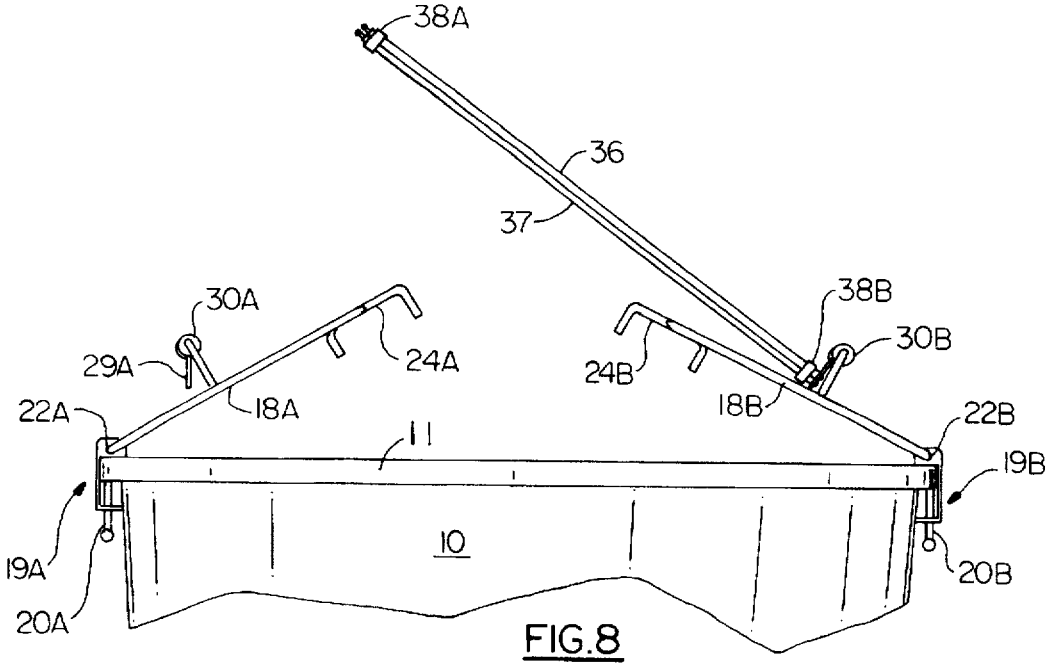
FIG. 8 is a fragmentary view of the base member embodiment of the invention of FIGS. 1 to 7 showing the two base half members being swung away from their operating position.

The bag engagement system of the invention includes a circular base member formed of two base half members 18A and 18B. Together they generally are coincident with the size and shape of the circular peripheral portion 11 of the bin 10. A releasable clamp 19A is located at the mid-point of the base half member 18A for releasable attachment to the peripheral portion 11 of the bin 10, and a similar clamp 19B is located at the mid-point of the base half member 18B for the same purpose. The clamps 19A and 19B include respective finger-operated set screws 20A and 20B for tightening respective body members 21A and 21B of the clamps 19A and 19B onto the peripheral portion 11 of the bin 10. Pivots 22A and 22B in the clamps 19A and 19B permit the respective base half members 18A and 18B to be swung up and away from engagement with the peripheral portion 11 of the bin 10, as shown in FIG. 8. It is intended that each half base member 18A and 18B be capable of swinging more than 180° from the peripheral portion 11 of the bin 10 to hang downwardly to one side of the bin 10 when not in operation.

Figure 7:
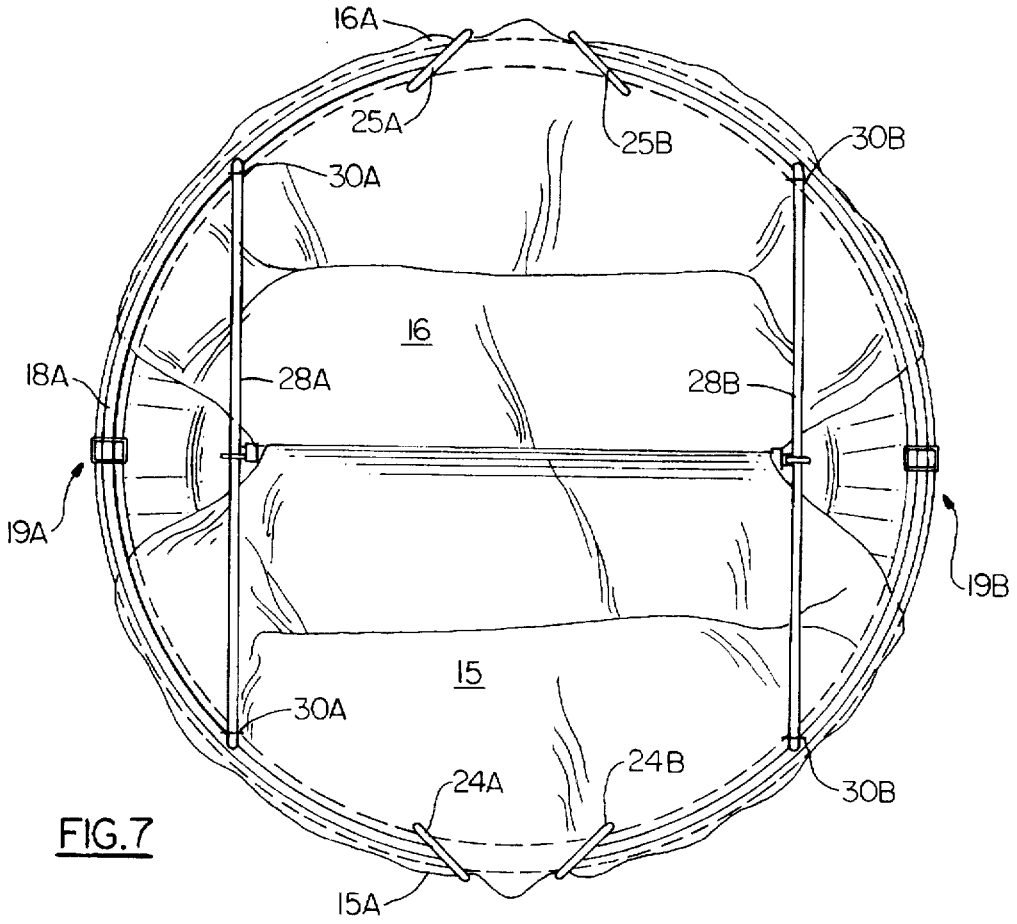
FIG. 7 is a top plan view taken along the line 7—7 of FIG. 2.

At opposite ends of the base half member 18A are affixed downwardly extending rod-like U-shaped bag holding elements 24A and 25A. At opposite ends of the base half member 18B are affixed similar bag holding elements 24B and 25B. They are all skewed slightly in relation to the curved base half members 18A and 18B so that one short leg of each of the bag-holding elements 24A and B and 25A and B is located on the outside of the peripheral portion 11 of the bin 10 in the operating position shown in FIG. 1 and the other short leg of each of bag-holding elements 24A and B and 25A and B is on the inside of the peripheral portion 11 of the bin 10. It will be noted that these bag-holding elements are approximately 90° around the circumference of the base half members from the respective clamps 19A and 19B. As shown in FIG. 7 the bag edge portion 15A lying over the peripheral portion 11 of the bin 10 is thereby held down in a somewhat fixed manner by the bag-holding elements 24A and 24B and the bag edge portion 16A is similarly held down by the bag holding elements 25A and 25B.

Extending integrally upwardly from the base half member 18A between the clamps 19A and bag-holding element 24A is an upstanding leg 26A. A similar upstanding leg 27A is affixed to the base half member 18A between the clamp 19A and the bag-holding element 25A. Extending between the upper ends of the legs 26A and 27A is a track element 28A. On the other base half member 18B similar upstanding legs 26B and 27B are affixed with a track element 28B between them. Thus the track elements 28A and 28B are parallel and in operating position are in a plane slightly above that of the peripheral portion 11 of the bin 10.

Referring particularly to FIGS. 3 to 6, a slide ring 29A encircles the track element 28A and a similar slide ring 29B encircles the track element 29B. They are prevented from sliding off the ends of their respective track elements 28A and 28B by stop elements 30A and 30B fixed to the ends of the track elements. These slide rings 29A and 29B are part of support means which also include key elements 31A and 31B suspended loosely from the respective slide rings 29A and 29B. The key element 31A is formed with a bayonet slot having an upper enlarged opening 33A and a lower restricted opening 34A. Similarly the key element 31B is formed with a bayonet slot having an upper opening 34B and a lower restricted opening 34B inward. Flange elements 32A and 32B extend inwardly from the lower ends of the key elements 31A and 31B respectively.

An arm assembly is provided which includes a pair of side-by-side gripper elements 36 and 37 held together by encircling elastic bands 38A and 38B at opposite ends of the pair. Screws 40A and 41A extend from the gripper elements 36 and 37 at one end of the pair and similar screws 40B and 41B extend from the opposite end of the pair of gripper elements 36 and 37.

In FIGS. 3 to 6 the screws 40A and 41A are shown received in the lower restricted opening 34A with the gripper elements 36 and 37 supported at their opposite ends by the flange elements 32A and 32B. When the gripper elements 36 and 37 are lifted upwardly the screws 40A and 41A enter the enlarged opening 33A and can be moved therefrom out of engagement with the key element 31A. At the other end of the pair of gripper elements 36 and 37 the elements 40B and 41B fit within a pair of washers 43 and 44, the former being between the inside of the key element 31B and the associated end of the gripper elements 36 and 37 and the latter being between the outside of the key element 31B and the heads of the screws 40B and 41B. Both of the washers 43 and 44 have elongated slots 46, one of which is visible in FIG. 6, in which the screws 40B and 41B are slidable, spreadable and rotatable.

By this construction the gripper elements 36 and 37 may be forced apart manually against the resistance of the elastic bands 38A and 38B and in doing so the screws 40B and 41B slide in the slots 46 of the washers 43 and 44. If the pair of gripper elements 36 and 37 is lifted the screws 40A and 41A may be removed from the key element 31A through the enlarged upper opening 33A, whereas the opposite end of the pair of the gripper elements 36 and 37 is held to the key element 31B by the washers 43 and 44.

In the operation of the embodiment of FIGS. 1 to 8, the base half members 18A and 18B are clamped in place by the clamps 19A and 19B on the peripheral portion 11 of the bin 10. They are swung from the operating position shown in FIG. 1 to hang down on either side of the bin 10. Two plastic refuse bags 15 and 16 are inserted in the bin 10 and the edges 15A and 16A of the bags are pulled over the peripheral portion 11 of the bin 10 as shown in FIG. 7. The base half members 18A and 18B are then swung downwardly into the operating position shown in FIG. 1 so that the bag-holding elements 24A, 25A, 24B and 25B hold the bag edge portions 15A and 16A in place. The gripper elements 36 and 37 are spread manually apart and the edge portions of both bags 15 and 16 joined together are inserted in the nip formed between the gripper elements 36 and 37. The gripper elements 36 and 37 are then lifted upwardly so that the screws 40-41A and 40-41B are in the enlarged openings 33A and 33B of the key elements 31A and 31B. Together the gripper elements 36 and 37 are then rotated as a single unit thus wrapping perhaps one and a half turns of the gripped bag edge portions around them. When that turning is completed the gripper elements 36 and 37 are lowered downwardly so that the screws 40A–41A and 40B–41B are in the lower restricted openings 34A and 34B of the key elements 31A and 31B. This effectively locks the pair of gripper elements 36 and 37, now covered at least in part by the wrappings of the bag edge portions, and prevents their rotation. If the weight of bag contents pulls downwardly on the bag edge portions that weight simply increases the grip on the wrapped bag edge portions.

The arm assembly formed by the pair of gripper elements 36 and 37 and the support means at each end thereof may be displaced slidably along the tracks 28A and 28B to alternately open one bag while closing the other and vice versa. Sorted refuse may be easily placed in either bag and the bag which holds refuse of larger volume can expand as needed at the expense of the companion bag which need only minimal space to receive refuse generated in lower volume. When a filled bag is to be removed from the bin 10 the operation of the gripper elements 36 and 37 is simply reversed. They are counter-rotated and spread apart and the bag edge portions between them are then removed. That end of the gripper element pair which is detachable, namely the end associated with the track 28A, is then swung parallel to the track 28B and releasably secured in some appropriate manner as by insertion within a spring clip affixed to one of the upwardly extending legs 26B or 27B.

Figure 9:
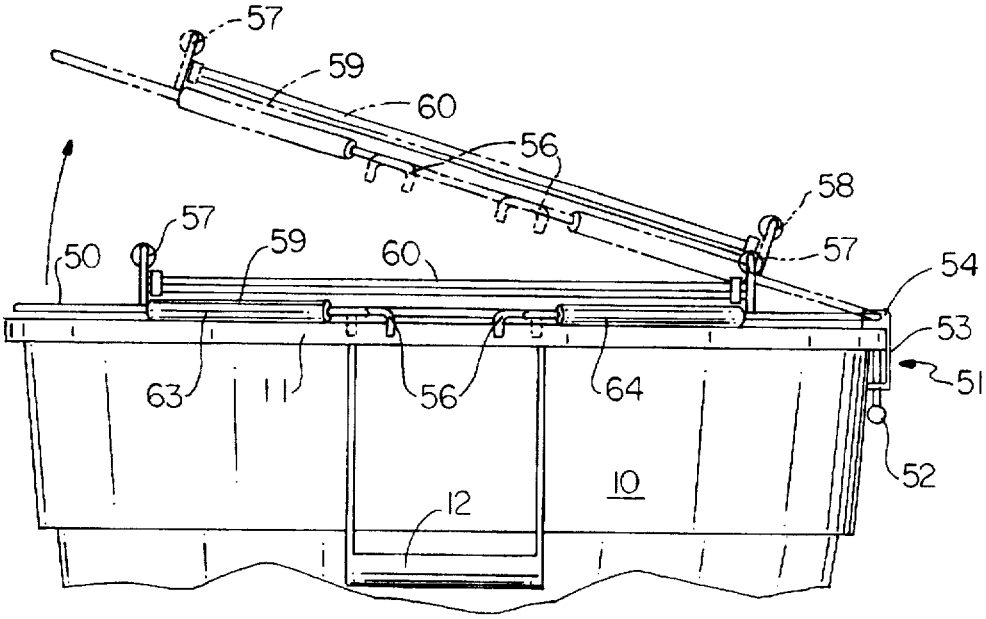
FIG. 9 is a fragmentary side view of another embodiment of the invention wherein the base member is a single member.

Referring now to FIG. 9, an embodiment of the invention is shown wherein the bin 10 is equipped with a bag engagement system in which the base member is a single member 50. It includes only one clamp 51 identical in form to the clamp 19B in the embodiment of FIGS. 1 to 8. Thus the clamp 51 includes a finger-operated set screw 52 for tightening its body member 53 onto the peripheral portion 11 of the bin 10. The clamp 51 also includes a pivot 54 permitting the single full ring base member 50 to be swung up and away from the peripheral portion 11 of the bind 10 as shown in broken lines in FIG. 9. Again, the pivot 54 is such that the base member 50 can be swung more than 180° from its operating position to hang downwardly to one side of the bin 10.

In the embodiment of FIG. 9 two pairs of bag-holding elements 56 are provided diametrically opposed to one another on the base member 50, one of the pairs being visible in FIG. 9. As with the elements 24A and 24B and the elements 25A and 25B in the embodiment of FIGS. 1 to 8, the bag-holding members 56 are skewed in relation to the circular base member 50 so that short legs extending from each bag-holding member 56 are located on the inside and outside respectively of the peripheral portion 11 of the bin 10 in the operating position shown in FIG. 9. As in the previous embodiment this permits an edge portion of a bag within the bin 10 to be held down in a somewhat fixed manner.

Figures 3, 4, 5, 6:
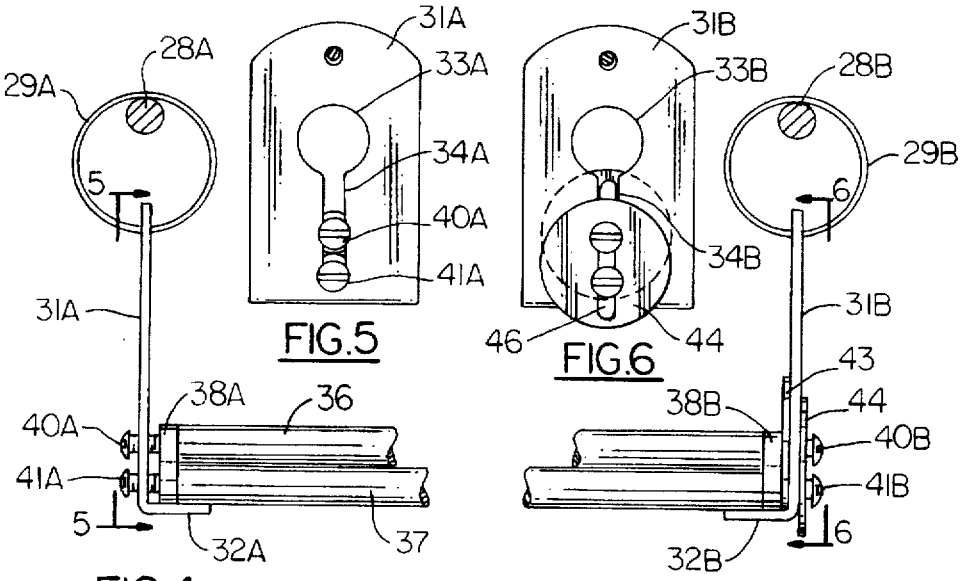
FIG. 3 is an enlarged fragmentary section taken along the line 3—3 of FIG. 1.
FIG. 4 is an enlarged fragmentary section taken along the line 4—4 of FIG. 1.
FIG. 5 is an end view of a support element permitting detachment of one end of the associated elongated gripper element.
FIG. 6 is an end view of a form of support element preventing detachment of the other end of the associated elongated gripper element.

In the embodiment of the bag engagement system of FIG. 9, parallel track elements 57 and 58 and an arm assembly including side-by-side gripper elements 59 and 60 are included with virtually the same form and function as the corresponding elements in the embodiment of FIGS. 1 to 8. A principal difference is that washers similar to washers 44 in FIG. 6 are provided at opposite ends of the gripper elements 59 and 60 because neither end of either of the gripper elements is to be detachable.

Four sections of split elastomeric hose, two of which namely 63 and 64 are visible in FIG. 9, are located symmetrically on four quadrant portions of the base member 50. The function of the split sections 60 and 61 is to space the base member 50 slightly above the upper surface of the upper peripheral portion 11 of the bin 10 when the bag engagement system is in the operating position shown in solid lines in FIG. 9. As a result of this spacing the bag edge portions disposed outwardly from the parallel tracks 56 and 57 may slide easily between the base member 50 and the upper surface of there peripheral portion 11 of the bin 10 as the arm assembly including the bag-holding elements 58 and 59 is slidably displaced back and forth to open and close the respective bags.

Figure 10:
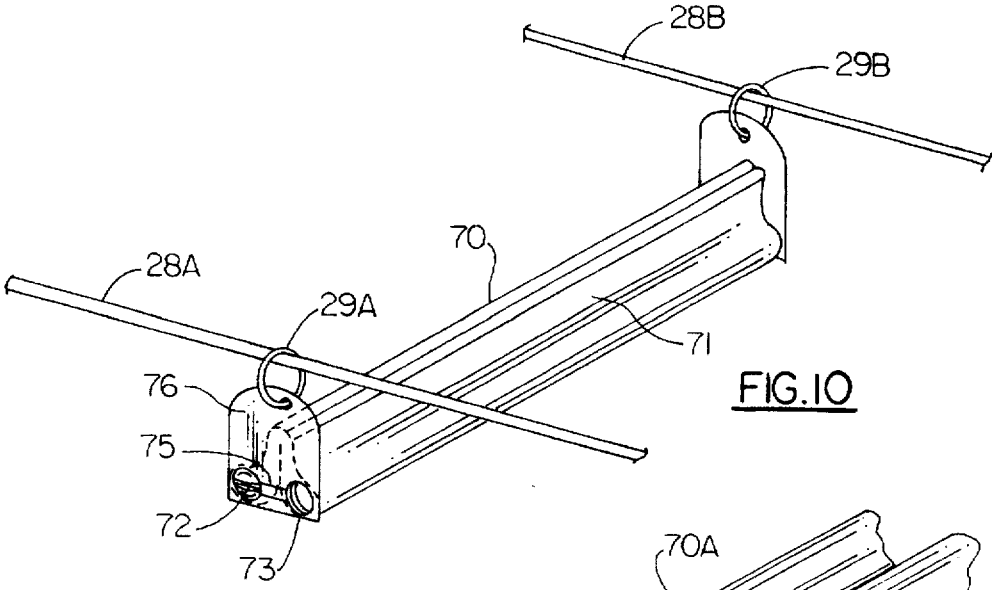
FIG. 10 is a fragmentary pictorial view of yet another embodiment of the invention wherein the elongated gripper element means includes curved cam surfaces.
Figure 11:
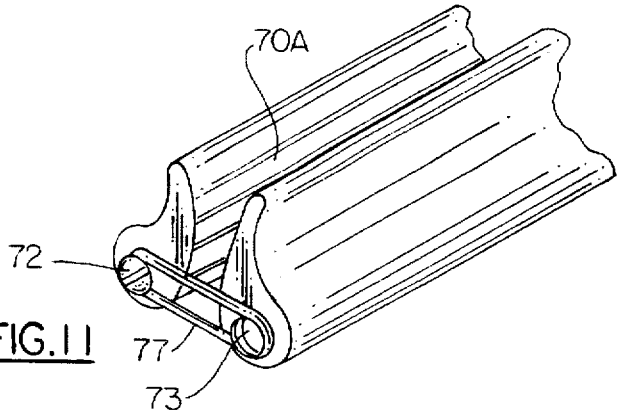
FIG. 11 is an enlarged fragmentary view of the end of the gripper elements of FIG. 10 showing them spread apart to receive a bag edge portion.

Turning now to the embodiment of FIGS. 10 and 11, most of the elements are the same in form and function as in the embodiment of FIGS. 1 to 8, including the track elements 28A and 28B and the slide rings 29A and 29B. However, in this embodiment of FIGS. 10 and 11 the gripper elements 36 and 37 are replaced by opposed curved cams 70 and 71. These cams have cam surfaces, one of which, namely 70A, is visible in FIG. 11, which are turnable about screws 72 and 73 at the opposite ends of the cam elements 70 and 71. The screws 72 and 73 of each pair are slidable toward and away from one another in an associated slot 75 formed in an associated key element 76 hanging from the respective slide ring 29A and 29B as in the embodiment of FIGS. 1 to 8. At the opposite ends of the cam elements 70 and 71 elastic bands are provided, one of which, namely band 77, is visible in FIG. 11, to urge the cam elements 70 and 71 together. Thus the cam surfaces on the cam elements 70 and 71 are both turnable about their respective screws 72 and 73 and are slidable by the action of the screws in their slots between an open position allowing insertion of the bag edge portion between them and a closed position pinching the bag edge portion between them. The curved configuration of the cam elements 70 and 71 is such that the weight of the bag contents increases their grip on the bag edge portion and also causes the cam elements 70 and 71 to lock against rotation when their cam surfaces are together as shown in FIG. 10.

The bag engagement system of the invention and its method of operation may be modified in many respects as will be apparent to a person skilled in the art. The scope of the invention is therefore to be determined by the following claims rather than the foregoing description of certain preferred embodiments of the invention.

I claim:

1. For use with a bag-holding structure having an upper opening and adapted to contain at least one bag, a bag engagement system for opening and closing the bag comprising a) axially rotatable elongated gripper element means on which an edge portion of the bag may be releasably gripped, b) locking means associated with said gripper element means to selectively prevent rotation of said gripper element means so that the weight of the bag contents increases the grip of the gripper element means on the bag edge portion, and c) support means for interconnecting the gripper element means with the bag-holding structure so that, with a bag edge portion opposite that gripped by the gripper element means held fixed, the bag may be selectively opened and closed by moving the gripper element means back and forth over the upper opening of the bag-holding structure.

2. A bag engagement system according to claim 1 which includes track means adapted to be secured adjacent the upper opening of the bag-holding structure and permitting access downwardly through said upper opening, and said gripper element means is a component of an arm assembly slidable back and forth along the track means.

3. A bag engagement system according to claim 2 wherein the track means comprises parallel track members.

4. A bag engagement system according to claim 1 or 2 wherein the upper opening of the bag holding structure is defined by a peripheral portion and the bag engagement system includes a base member adapted to be placed against the peripheral portion of the bag-holding structure.

5. A bag engagement system according to claim 4 wherein the base member includes means for holding fixed the bag edge portion opposite that gripped by the gripper element.

6. A bag engagement system according to claim 4 wherein the base member includes a clamp for releasable attachment to the peripheral portion of the bag-holding structure.

7. A bag engagement system according to claim 6 wherein the clamp includes a pivot permitting the track means to be selectively disposed over the opening of the bag-holding structure and alternatively swung aside from that opening to permit insertion and removal of said bag.

8. A bag engagement system according to claim 1 wherein the bag-holding structure is adapted to contain at least two bags and the elongated gripper element means is adapted to releasably grip joined edge portions of both of the two bags.

9. In combination with a bag-holding structure having an upper opening defined by a peripheral portion and adapted to contain at least one bag, a bag engagement system for opening and closing the bag comprising a) parallel track members secured adjacent the peripheral portion of the upper opening of the bag-holding structure and permitting access downwardly through said upper opening;

b) an arm assembly slidable back and forth along the track members comprising i. axially rotatable elongated gripper element means on which an edge portion of the bag may be releasably gripped, ii. locking means associated with said gripper element means to selectively prevent rotation of said gripper element means so that the weight of the bag contents increases the grip of the gripper element means on the bag edge portion, iii. support means interconnecting the gripper element means with the track members so that, with a bag edge portion opposite that gripped by the gripper element means held fixed, the bag may be selectively opened and closed by moving the gripper element means back and forth along the track members;

c) a base member adapted to be placed against the peripheral portion of the upper opening of the bag-holding structure; and d) a clamp on said base member for releasable attachment to the periphery of the bag-holding structure;

e) a pivot associated with said clamp permitting the bag engagement system to be selectively turned over the opening of the bag holding structure and alternatively swung aside from that opening to permit insertion and removal of said bag.

10. For use with a bag-holding structure having an upper opening and adapted to contain at least one bag, a bag engagement system for opening and closing the bag comprising a) track means adapted to be secured across at least a portion of the upper opening of the bag-holding structure and permitting access downwardly through said upper opening; and b) an arm assembly slidable back and forth along the track means comprising i. a pair of elongated side-by-side gripper elements axially rotatable with respect to one another and forming nip means in which an edge portion of the bag may be releasably gripped with the weight of the bag contents increasing the grip on the bag edge portion, and ii. support means interconnecting the gripper element pair with the track means and slidable along the track means so that, with a bag edge portion opposite that gripped by the gripper elements held fixed, the bag may be selectively opened and closed by sliding the arm assembly back and forth along the track means.

11. A bag engagement system according to claim 10 wherein the gripper element pair is selectively rotatable on the support means and adapted to be locked against rotation on the support means so that the pair of gripper elements may be rotated to wrap the bag edge portion about themselves and then locked so that the weight of the bag contents holds the wrapped bag edge portion about the gripper element pair.

12. A bag engagement system according to claim 11 wherein each support element defines a bayonet slot having an enlarged opening into which an end of the associated gripper element pair may be moved to permit its rotation and a restricted opening into which the end of the associated gripper element pair may be moved to lock against rotation.

13. A bag engagement system according to claim 11 wherein washer means are included on at least one end of the gripper element pair to prevent detachment from the associated support means.

14. A bag engagement system according to claim 10 wherein the gripper elements include opposed curved cam surfaces turnable and spreadable between an open position allowing insertion of the bag edge portion between them and a closed position pinching the bag edge portion between them under the weight of the bag contents.

15. A bag engagement system according to claim 10 wherein the gripper elements are rods biased together by elastic means associated with the rod pair.

16. A bag engagement system according to claim 15 wherein the elastic means is a pair of elastic bands encircling the rod pair adjacent the respective opposite ends of the rod pair.

17. A bag engagement system according to claim 10 wherein the track means comprises parallel track members.

18. A bag engagement system according to claim 10 wherein each support element hangs slidably on one of the track members.

19. A bag engagement system according to claim 10 wherein the upper opening of the bag-holding structure is defined by a peripheral portion and the bag engagement system includes a base member adapted to be placed against the peripheral portion of the bag-holding structure.

20. A bag engagement system according to claim 19 wherein the base member includes means for holding against the peripheral portion of the bag-holding structure at least one bag edge portion to one side of the back and forth path of the arm assembly on the track means.

21. A bag engagement system according to claim 19 wherein the base member includes a clamp for releasable attachment to the peripheral portion of the bag-holding structure.

22. A bag engagement system according to claim 21 wherein the clamp includes a pivot permitting the bag engagement system to be selectively turned over the opening of the bag-holding structure and alternatively swung aside from that opening to permit insertion and removal of said bag.

23. A bag engagement system according to claim 22 wherein the base member comprises two base half members each with its own clamp and pivot and the track means comprises a pair of track members one of which is secured to each of the respective two base half members.

24. A bag engagement system according to claim 22 wherein the base member comprises a single member with a clamp and pivot and the track means comprises a pair of track members both secured to the single base member.

25. A bag engagement system according to claim 19 wherein the track means is elevated above the base member.

26. A bag engagement system according to claim 19 wherein the upper opening of the bag-holding structure is circular and the base member is circular corresponding to the shape of the bag-holding structure opening.

27. A bag engagement system according to claim 10 wherein the bag-holding structure is adapted to contain at least two bags and the elongated gripper elements are adapted to releasably grip joined edge portions of both of the two bags.

* * * * *